US006406558B1

(12) United States Patent
Kurosawa et al.

(10) Patent No.: US 6,406,558 B1
(45) Date of Patent: Jun. 18, 2002

(54) METHOD FOR MANUFACTURING MAGNETIC STEEL SHEET HAVING SUPERIOR WORKABILITY AND MAGNETIC PROPERTIES

(75) Inventors: Mitsumasa Kurosawa; Masaki Kawano; Michiro Komatsubara; Keiji Sakai; Toshiro Fujiyama, all of Okayama (JP)

(73) Assignee: Kawasaki Steel Corporation (JP)

( * ) Notice: Subject to any disclaimer, the term of this patent is extended or adjusted under 35 U.S.C. 154(b) by 0 days.

(21) Appl. No.: 09/703,229

(22) Filed: Oct. 31, 2000

(30) Foreign Application Priority Data

Nov. 1, 1999 (JP) ..... 11-310954

(51) Int. Cl.[7] ..... H01F 1/147
(52) U.S. Cl. ..... 148/120; 148/111
(58) Field of Search ..... 148/111, 112, 148/120, 121

(56) References Cited

U.S. PATENT DOCUMENTS 5,413,640 A * 5/1995 Manabe et al. ..... 148/111
5,639,315 A * 6/1997 Takashima et al. ..... 148/120
5,803,989 A * 9/1998 Kawamata et al. ..... 148/120

FOREIGN PATENT DOCUMENTS

JP 6-57332 * 3/1994 ..... 148/111
JP 6-192731 * 7/1994 ..... 148/111

* cited by examiner

*Primary Examiner*—John Sheehan
(74) *Attorney, Agent, or Firm*—Schnader Harrison Segal & Lewis LLP

(57) ABSTRACT

Manufacturing semiprocessed non-oriented magnetic steel sheets, which has superior workability in steps of assembling cores for motors or the like, in which improvement in productivity and higher accuracy of the products can be realized, by hot rolling a steel slab containing about 0.001 to 0.03 wt % C, about 0.1 to 1.0 wt % Si, about 0.01 to 1.0 wt % Al, about 0.05 to 1.0 wt % Mn, and about 0.001 to 0.15 wt % P, cold rolling the hot rolled sheet, continuous annealing the cold rolled sheet, and skin pass rolling the annealed sheet, wherein the average cooling rate in the continuous annealing process is about 10° C./second or more and skin pass rolling is performed at a reduction rate of about 0.5 to 5% within about 20 hours after continuous annealing.

4 Claims, 1 Drawing Sheet

METHOD FOR MANUFACTURING MAGNETIC STEEL SHEET HAVING SUPERIOR WORKABILITY AND MAGNETIC PROPERTIES

BACKGROUND OF THE INVENTION

1. Field of the Invention

The present invention relates to methods for manufacturing non-oriented magnetic steel sheets having superior magnetic properties. Such sheets are ideally suitable as magnetic components for rotating elements such as electric motor cores and the like.

In particular, this invention relates to methods for manufacturing semiprocessed non-oriented magnetic steel sheets having superior workability in assembling iron cores for motors and the like, and having superior magnetic properties after stress relief annealing following assembly.

As referred to herein, a "semiprocessed" magnetic steel sheet is a substantially non-oriented magnetic steel sheet which exhibits superior magnetic properties after stress relief annealing. Usually, stress relief annealing is performed at 700 to 800° C. for approximately 2 hours following the step of die cutting the sheet by customers. In general, the non-oriented steel sheet is manufactured by pickling hot-rolled steel sheets with or without annealing thereof, and cold rolling, annealing and skin pass rolling the sheet.

2. Description of the Related Art

Magnetic sheet steel materials for rotating motor or generator cores or the like are magnetized in various directions substantially parallel to the surfaces of the materials. Such materials have substantially no magnetic anisotropy and are accordingly very advantageous for use in rotating electrical components and the like.

A method is disclosed in Japanese Examined Patent Application Publication No. Hei-7-59725 in which hot rolling conditions are controlled, and a method is disclosed in Japanese Unexamined Patent Application Publication No. Hei-3-75313 in which annealing is performed for hot-rolled steel sheets.

In addition, recently, in order to alleviate the effect of magnetic anisotropy of the steel sheets after performance of die cutting operations for cores for motors, manufacturing methods for making iron cores have been somewhat improved. For example, a so-called "rotation piling" method can be performed, in which, when a set of a predetermined number of cores is piled, a following set of cores is piled at or along one or more different angles therefrom, by rotating. As a result, differences in performances of motor cores caused by anisotropy of materials are not very significantly manifested, compared to those conventionally observed.

Recently, the processes of assembling motor cores have been significantly automated. As a result, in particular, improvements of material thickness accuracy and of die cutting properties have been strongly desired.

Concerning improvements of material thickness accuracy and of die cutting properties, some methods have been proposed; for example, Japanese Examined Patent Application Publication No. Hei-4-25345 disclosed a method in which grain diameters of a steel sheet are controlled before skin pass rolling, Japanese Unexamined Patent Application Publication No. Hei-9-35925 disclosed a method in which an appropriate amount of titanium (Ti) is added, and Japanese Unexamined Patent Application Publication No. Hei-10-25552 disclosed a method in which material elongation percentage is controlled. However, since the methods mentioned above are proposed from experimental results based on the observed phenomena, the reasons for the proposals are not sufficiently explained, and in addition, any effects achieved are not sufficient for practical commercial use.

SUMMARY OF THE INVENTION

An object of the present invention is to provide a manufacturing method which can be advantageously applied to the manufacture of semiprocessed magnetic steel sheets, in which productivity increase and higher accuracy of product thickness can be realized by improving workability of a die cutting step without impairing the magnetic properties of the sheet. Improvements of workability in a die cutting step can be achieved by, for example, reducing flash height and reducing material thickness variation.

According to the present invention, the method for manufacturing a semiprocessed non-oriented magnetic steel sheet having superior workability and magnetic properties after stress relief annealing, comprises hot rolling a steel slab containing about 0.001 to 0.03 wt % carbon (C), about 0.1 to 1.0 wt % silicon (Si), about 0.01 to 1.0 wt % aluminum (Al), about 0.05 to 1.0 wt % manganese (Mn), and about 0.001 to 0.15 wt % phosphorus (P), cold rolling the hot rolled sheet, continuously annealing the cold rolled sheet and skin pass rolling the annealed sheet, wherein the average rapid cooling rate of continuous annealing is about 10° C./second or more, and wherein skin pass rolling is performed at a reduction rate of about 0.5 to 5% within about 20 hours after the rapid cooling is completed. In addition, in the method of the present invention, rapid cooling in the continuous annealing step is preferably performed at a rate of about 10° C./second or more between about 600 to 400° C. Furthermore, the steel slab preferably further comprises at least one of about 0.001 to 0.20 wt % tin (Sn), about 0.001 to 0.10 wt % antimony (Sb), and about 0.001 to 0.010 wt % boron (B), and the difference between the amount of carbon present in the steel slab and the $C_{eq}$ obtained by the equation (1) shown below is preferably about 0.001 wt % or more, in which the $C_{eq}$ value is calculated from the wt % amounts of the impurities titanium (Ti), niobium (Nb), vanadium (V), and zirconium (Zr) in the steel slab. The equation is:

$$C_{eq}(\text{wt }\%)=12\times\{[\text{Ti}(\text{wt }\%)]/48+[\text{Nb}(\text{wt }\%)]/93+[\text{V}(\text{wt }\%)]/51+[\text{Zr}(\text{wt }\%)]/92\} \quad (1)$$

DESCRIPTION OF THE PREFERRED EMBODIMENTS

Figure 1:
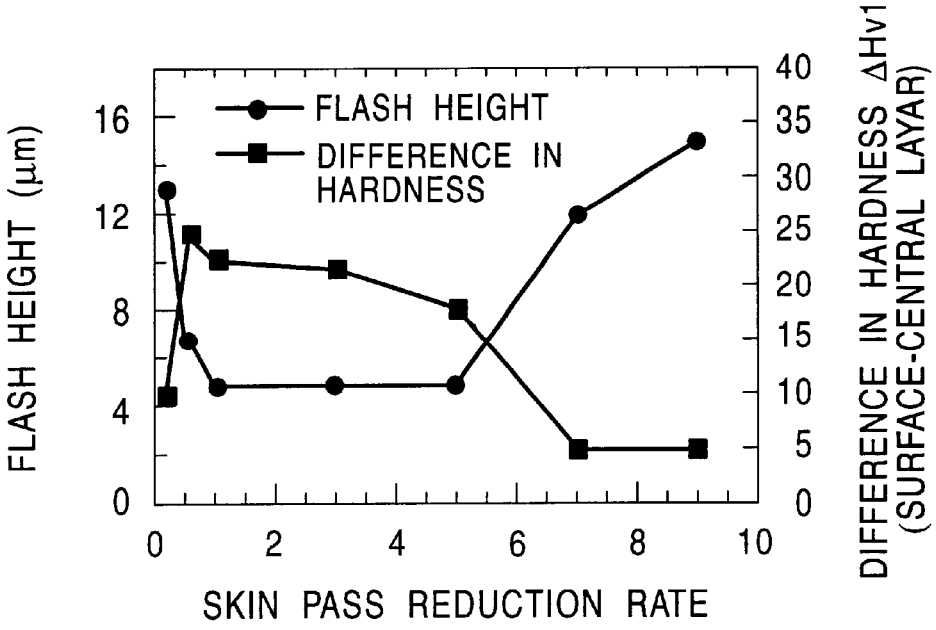
FIG. 1 is a graph showing the influence of reduction rates in skin pass rolling on flash height and hardness difference between surface and center of a sheet.

We researched various manufacturing methods in order to improve the die cutting properties of the semiprocessed magnetic steel sheets described above. We discovered that there was a significant relationship between skin pass rolling conditions applicable to the semiprocessed magnetic steel sheet and the composition thereof.

We researched the influence of steel sheet compositions on optimum reduction rates in skin pass rolling. We found that the content of carbon is a dominant factor for improving workability of the steel sheet and simultaneously improving its magnetic properties after stress relief annealing.

Hereinafter, experimental results obtained will be described.

First, a steel ingot was formed which contained 0.007 wt % C, 0.40 wt % Si, 0.25 wt % Mn, 0.02 wt % P, 0.005 wt % S, 0.20 wt % Al, and 0.004 wt % nitrogen (N). A sheet bar 50 mm thick was formed from the steel ingot, and the sheet bar was heated to 1,100° C. and hot rolled to 2.5 mm thick. The hot-rolled steel sheet was pickled and was then cold-rolled to an intermediate thickness. The intermediate thickness was controlled so that reduction rates by skin pass rolling performed later were 0.5, 1, 2, 5, and 10%. After the cold-rolled steel sheets were annealed at 750° C. for 1 minute, they were quenched to room temperature at a cooling rate of 20° C./second, and immediately, they were skin pass rolled to 0.50 mm thick.

In order to measure workability, a test sample of 15 mm by 15 mm square was die-cut from the skin pass rolled steel sheet, and the die-cut face thereof was observed. By observation an areal ratio of the shear portion in the thickness direction and the flash height were measured. Flash or burr is elongated and broken portion which is created at cutting edge. Flash height is a parameter which represents the appearance of die-cut face and strongly related to the workability of the sheet. When flash height is large, the appearance of die-cut face is poor and usually trimming is necessary. Flash height is measured by averaging four maximum lengths of flash at each cutting face. In this step, clearance for the die cutting was set at 25 $\mu$m, which was approximately 5% of the thickness of the steel sheet.

Stress relief annealing at 750° C. for 2 hours was performed upon the skin pass rolled steel sheets formed at various reduction rates. In addition, in order to evaluate magnetic properties, Epstein test specimens were prepared. Four Epstein test specimens in which the longitudinal direction thereof was in the rolling direction (hereinafter referred to as the "L direction") and four Epstein test specimens in which the longitudinal direction thereof was in a direction perpendicular to the L direction (hereinafter referred to as the "C direction") were prepared, and eight-specimen Epstein tests were performed. The test results of magnetic flux density $B_{50}$ (T) and iron loss $W_{15/50}$ (W/kg), which were respectively measured, are shown in Table 1.

In condition 1 in which skin pass rolling was not performed, satisfactory magnetic properties were not obtained. The reason for this was believed to be that grain growth during the stress relief annealing step was insufficient. In condition 6 in which the skin pass reduction rate was high, the workability of the steel sheet was inferior since the areal ratio of the shear portion was less than 50%, and the flash height was 10 $\mu$m or more. On the other hand, steel sheets formed in a specified range of skin pass reduction rates had improved magnetic properties and improved workability.

In addition, die-cut faces were observed in detail. In the condition 6 in which the areal ratio of the shear portion was small, the boundary between the shear portion and the fracture portion had an irregularly disordered form. In contrast, in the conditions 2 to 5, the boundaries thereof were straight, and the die-cut faces had forms in which flashes were only sparingly generated if at all. In addition, when the conditions 1 and 2 were compared with each other, with the same areal ratios of shear portions, a difference in the condition of the boundary between the shear portion and the fracture portion was observed. That is, compared to the condition 2, the form of the boundary of the condition 1 was disordered.

From the results obtained from the experiments thus described, it was believed that there would be some relationship between the die cutting properties and the skin pass reduction rate. Accordingly, when even more detailed research was performed, it was confirmed that, in the conditions 2 to 5 in which the skin pass reduction rates thereof were about 0.5 to 5%, there was a large and important difference in hardness at the surface of the steel sheet compared to hardness at the inside thereof.

Accordingly, experiments in a manner equivalent to those described above were performed in detail at even further various skin pass reduction rates, and the influences of the skin pass reduction rates were researched against the difference in Vickers hardness ($H_{Vl}$) of the surface and the inside of the steel sheet. The results are shown in FIG. 1. In these experiments, hardness measurement was performed at a die-cut face of a steel sheet, which was processed by mechanical polishing and was then processed by chemical polishing so as to release stresses generated by the mechanical polishing.

As shown in FIG. 1, in the range of skin pass reduction rate of about 0.2 to 5%, a steel sheet having superior workability was obtained, in which the flash height was small, and the difference in hardness was large. The reason why the surface of the steel sheet was hardened more than the inside thereof was believed to be that strain aging occurred at the surface thereof. That is, it was believed that strains were locally introduced in the surface of the steel sheet by skin pass rolling, and the strains and the dissolved carbon interacted with each other, causing strain aging to progress.

When the surface of the steel sheet is preferentially hardened, at the initial shearing stage in die cutting, the boundary between the shear face and the fracture face is uniformly formed. This is due to the difference in deformation capacity between the hardened portion and the non-hardened portion of the material. In addition, at the later shearing stage at which the steel sheet is cut apart, a die cutting tool is again passed through the hardened portion. As a result, it is believed that the rate of flash generation can be minimized.

Furthermore, appropriate carbon amounts and associated manufacturing conditions were intensively researched.

Steel ingots respectively having C contents in an amount of 0.0005 wt % (Steel A), 0.0010 wt % (Steel B), 0.0025 wt % (Steel C), 0.011 wt % (Steel D), 0.030 wt % (Steel E) and 0.048 wt % (Steel F) were formed, in which the individual steel ingots contained 0.20 wt % Si, 0.25 wt % Mn, 0.10 wt % P, 0.003 wt % S, 0.35 wt % Al, and 0.002 wt % N. Sheet bars 50 mm thick were formed from the steel ingots described above, and the sheet bars were heated to 1,100° C. and hot-rolled to 2.5 mm thick. The hot-rolled steel sheets were pickled and then cold-rolled to an intermediate thickness so as to satisfy a skin pass reduction rate of 3%. After the cold-rolled steel sheets were annealed at 750° C. for 1 minute, the annealed steel sheets were quenched to room temperature at cooling rates of 5, 10, and 50° C./second, and annealed sheets were immediately skin pass rolled to 0.50 mm thick. Workability and magnetic properties were evaluated in a manner equivalent to those in the first experiment. The results are shown in Table 2.

Superior magnetic properties could not be obtained for the steel F containing a large amount of C. The reason for this is believed to be that grain growth was not sufficient in the stress relief annealing. The steel A having a small amount of C was inferior in workability regardless of cooling rates, since the areal ratio of the shear portion was less than 50%, and the flash height was 10 $\mu$m or more. On the other hand, the steels B to E exhibited superior workability when they were cooled at a cooling rate of 10° C./second or more. The reason why the workability at a cooling rate of 5° C./second was degraded was believed to be: since the cooling took a long time, C atoms diffused or precipitated to the grain boundary, and hence, the amount of C dissolved in the grains was decreased. Since the dissolved C decreased, interaction between the carbon and the strain locally generated by skin pass rolling, i.e., dislocation, was not sufficient, strain aging would not progress, and as a result, the surface of steel sheet was insufficiently hardened.

As described above, when the strain introduced in the surface of steel sheet and the dissolved C remaining therein advantageously interact with each other, it is believed that superior workability can be obtained. In this connection, unavoidable impurities mixed in the molten steel were found to react with C so as to form carbides, and as a result, the amount of the dissolved C was reduced. As impurities there may be mentioned, for example, Ti, Nb, V, and Zr. In order to perform the interaction between the strain introduced by skin pass rolling and the dissolved C, it is important that a predetermined amount of the dissolved C remains after the intermediate annealing stage. Accordingly, it was also discovered that the amount obtained by the C amount in a intermediate annealed steel sheet, less the C equivalent (represented by $C_{eq}$) which reacts with the impurities described above, is advantageously controlled to be about 0.001 wt % or more, in addition to controlling the lower limit of the C amount. The $C_{eq}$ is represented by the following equation (1):

$$C_{eq}(\text{wt }\%)=12\times\{[\text{Ti(wt }\%)]/48+[\text{Nb(wt }\%)]/93+[\text{V(wt }\%)]/51+[\text{Zr(wt }\%)]/92\} \quad (1).$$

Figure 2:
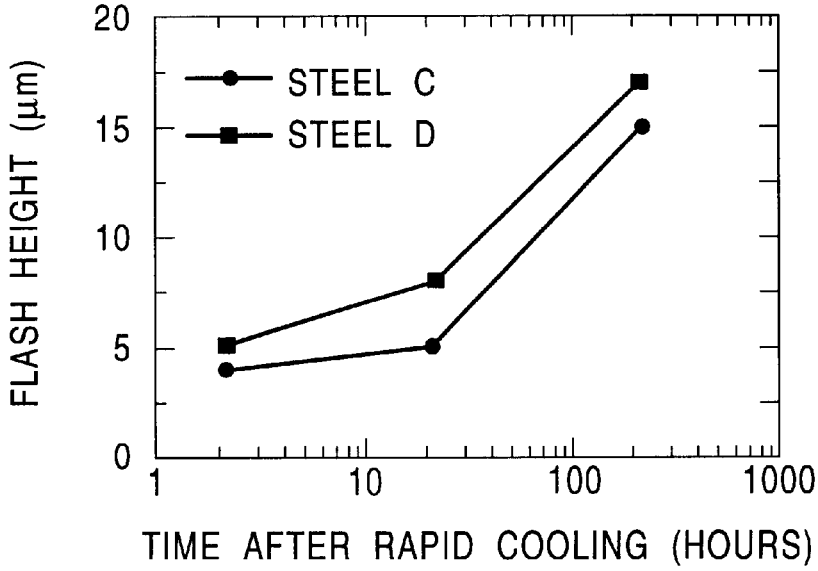
FIG. 2 is a graph showing the influence of time on flash height after rapid cooling is completed.

In addition, even when the C amount is controlled to be about 0.001 to 0.30 wt %, before strain is introduced in the surface of a steel sheet, the amount of the dissolved C may be decreased by aging or the like in some cases. As a result, the effect of the strain locally generated in the surface of a steel sheet may be lost in some cases. Accordingly, changes in workability with time after rapid cooling were researched. The steels C and D described above were rapidly cooled from 650 to 350° C. at a rate of 15° C./second, and when 2, 20, and 200 hours passed after rapid cooling, skin pass rolling was respectively performed at a reduction rate of 2%, thereby obtaining steel sheets of 0.50 mm thick. Workability was evaluated in a manner equivalent to that in the experiment described above. The results are shown in FIG. 2.

When the time after rapid cooling was longer, the flash height was increased, and hence, the desired effect of the present invention could not be obtained. That is, it was discovered that skin pass rolling must be performed within about 20 hours after completion of rapid cooling.

According to the results thus obtained, it was found that, when the C content was set to be about 0.001 to 0.03 wt %, and preferably, the C content reduced by the C equivalent in a hot-rolled steel sheet was controlled to be about 0.001 wt % or more, a cooling rate after annealing was set to be 10° C./second or more, and skin pass rolling was performed within 20 hours after rapid cooling, both magnetic properties and workability of the steel sheet could be simultaneously obtained.

Next, in a method for manufacturing a semiprocessed non-oriented magnetic steel sheet of the present invention, conditions and ranges thereof for obtaining the desired effects and advantages will be described in detail.

The composition of the steel sheet will first be described.

C: about 0.001 to 0.03 wt %

Since, when the content of C exceeds about 0.03 wt %, magnetic properties are degraded due to poor grain growth during stress relief annealing, the content of C is set to be about 0.03 wt % or less. More preferably, the content thereof is set to be about 0.02 wt % or less at which cementite is substantially insoluble during stress relief annealing. On the other hand, when the C content is less than about 0.001 wt %, sufficient hardening does not occur at the surface of a steel sheet after skin pass rolling, and improved workability cannot be obtained. Accordingly, the content of C needs to be about 0.001 wt % or more.

Recently, in steel sheets which are used for non-oriented magnetic steel sheets, unavoidable impurities contained therein reach levels at which they cannot be ignored. When unavoidable impurities are carbide-forming elements, such as Ti, Nb, V, and Zr, C is consumed to form carbides, and as a result, the increase of hardness may be insufficient in some cases. Ti and Nb are increasingly used for producing the steel sheets for deep drawing. Depending on the casting timing for non-oriented magnetic steel sheets and steel sheets for deep drawing, the unavoidable impurities will be increasingly mixed in non-oriented magnetic steel sheets. In addition, contaminations by V from pig iron and by Zr from a ladle may also occur in some cases.

In order to effectively exploit C in combination with a skin pass reduction rate according to the present invention, carbide-forming elements, such as Ti, Nb, V, and Zr, and in addition, such as tantalum (Ta) and tungsten (W), must be reduced to values as small as possible. In other words, the content of dissolved C must be maintained at a certain level. It is important that the amount of C is maintained in consideration of the C equivalent required for forming TiC, NbC, VC, ZrC, TaC, WC, and the like.

In particular, Ti, Nb, V, and Zr preferably meet the conditions described below. That is, the C equivalent ($C_{eq}$) is defined by the equation (1) as a guideline of a total amount of these elements mentioned above. In addition, the modified content of dissolved C, obtained by subtracting the $C_{eq}$ value from the C content, is controlled to be about 0.001 wt % or more, according to the equation:

$$C_{eq}(\text{wt }\%)=12\times\{[\text{Ti(wt }\%)]/48+[\text{Nb(wt }\%)]/93+[\text{V(wt }\%)]/51+[\text{Zr(wt }\%)]/92\} \quad (1)$$

Other carbide-forming impurities are not so frequently used, and hence, they are generally in ranges which can be ignored. Accordingly, the amount of the dissolved C may be primarily controlled in consideration of the Ceq value described above. Naturally, it is most preferable that the amount of dissolved C, obtained in consideration of carbide-forming impurities including others, be controlled to about 0.001 wt % or more. In this connection, when Ti, Nb, V, and Zr, and in addition, Ta, W, and the like are mixed in a steel sheet, individual elements are preferably controlled to be about 0.006 wt % or less, respectively.

Si: about 0.1 to 1.0 wt %

Si is an element which increases electric resistance and decreases iron loss, and about 0.1 wt % Si or more must be present. However, in order not to degrade workability required for semiprocessed steel sheets, the content thereof is set to be about 1.0 wt % or less.

Mn: about 0.05 to 1.0 wt %; and P: about 0.001 to 0.15 wt %

Mn and P are effective to increase electric resistance and to adjust hardness. The contents of Mn and P are set to be about 0.05 to 1.0 wt % and about 0.001 to 0.15 wt %, respectively, similarly to those employed for common non-oriented magnetic steel sheets.

Al: about 0.01 to about 1.0 wt %

Al is effective for deoxidation during the steel-making process and improving the magnetic properties of steel sheets. Generally, about 0.001 to 1.0 wt % Al may be added. In order to decrease the 0 content to about 0.005 wt % or less, so as to reduce harmful elements which degrade magnetic properties, about 0.01 wt % Al or more is necessary. In addition, the content of Al is set to be about 1.0 wt % or less, so as not to degrade the workability required for semiprocessed steel sheets.

Dissolution-enhancing elements, such as Ni, Co, and Cu, are effective to adjust hardness, to increase resistivity, and to improve texture of steel sheets. Accordingly, they may be respectively present in an amount of about 1.0 wt % or less, when necessary.

S and N are elements which form precipitates and degrade magnetic properties of steel sheets. Accordingly, the lower the contents thereof, the better the properties of the steel sheets. As is the case with common non-oriented magnetic steel sheets, it is preferable that the contents of S and N be controlled to be about 0.02 wt % or less and about 0.005 wt % or less, respectively.

Sn, Sb, and B are elements which are conventionally known to have significant effects of improving magnetic properties of steel sheets. In addition, these elements will not impair the features of the present invention. Accordingly, Sn, Sb, and B are preferably used alone or in combinations of at least two thereof. As the ranges to be used, about 0.001 to 0.20 wt % Sn, about 0.001 to 0.10 wt % Sb, and about 0.001 to 0.010 wt % B are preferable.

Steel having a composition as described above may be formed as steel slabs by continuous casting, or a method for forming steel product sheets directly from molten steel may be used.

The slab is heated and is then formed into a hot-rolled steel sheet by hot rolling. The heating temperature for the slab is set to be about 1,250° C. or less, or preferably, is set to be about 1,200° C. or less. The temperature for heating the slab is set as described above so as to form larger MnS and AlN particles by precipitation control. Naturally, direct rolling may be performed by utilizing remaining heat of the slab. Coiling sheet at a high temperature after hot rolling is not preferable because tight scales are generated and pickling performed in a subsequent step becomes difficult. Furthermore, decarburization proceeds by self-annealing, and as a result, the C content is not uniform in the longitudinal direction of the coil. Accordingly, the coiling temperature is controlled to about 700° C. or less, and preferably, about 600° C. or less.

After hot rolling, annealing for hot-rolled sheets may be performed between pickling steps, or cold rolling may be performed more than two times with intermediate annealing therebetween. Both of these are steps for improving the stability of the magnetic properties. However, when productivity is considered, a process is preferable in which pickling, one cold rolling, annealing, and skin pass rolling are sequentially performed. In the process described above, the reduction rate in cold rolling is about 60 to 90%. When the reduction rate is less than about 60%, a superior texture cannot be obtained, and in contrast, when the reduction rate exceeds about 90%, rolling may be difficult if cold rolling is performed only one time.

The cold rolled sheets are heated to 700–800° C., soaked and cooled by continuous annealing. Cooling during continuous annealing is composed of slow cooling before a forced cooling zone by spontaneous cooling and rapid cooling in the forced cooling zone. In general, steel sheets are cooled to approximately 300° C. by cooling during continuous annealing. In the present invention, dissolved C must remain before skin pass rolling. Accordingly, it is an important factor of the present invention that cooling during continuous annealing be at least performed at an average rate of about 10° C./second or more. When the rate is less than about 10° C./second, C is precipitated as cementite. In addition, in order to cause dissolved C to maximally remain after annealing, it is important that the rapid cooling be performed at least at a rate of about 10° C./second between about 600 to 400° C. The step of cooling described above is particularly effective when the content of C is low, such as about 0.005 wt % or less.

Next, the reduction rate of skin pass rolling, which is an essential factor of the present invention, is controlled to be about 0.5 to 5%. When the reduction rate is less than about 0.5%, grain growth is not sufficiently facilitated in stress relief annealing. On the other hand, even when the reduction rate is more than about 5%, the effect of facilitating grain growth is saturated in steels in which impurities are sufficiently reduced, as is the composition of the present invention. In addition, in rolling at a reduction rate of about 5% or more, strain is introduced in the entire thickness direction of the steel sheet. That is, hardening at the surface portions of steel sheets is low, which is induced by the interaction between the strain introduced by skin pass rolling in surface portions of steel sheets and dissolved C, and hence, workability is not improved.

In addition, in order to sufficiently harden surface portions of steel sheets, skin pass rolling must be performed within 20 hours after rapid cooling. Since the diffusion of C atoms is sufficiently rapid even at room temperature, when steel sheets are left more than 20 hours after rapid cooling, C is precipitated at portions where strains are introduced by rapid cooling. That is, selective diffusion of C atoms would not occur at surface portions where strains are introduced by skin pass rolling. Consequently, it is believed that the surface portions are not sufficiently hardened.

In order to exploit this novel technical information, it is advantageous that skin pass rolling be continuously performed in a continuous annealing line provided with a skin pass rolling machine at a side where cooled steel sheets are discharged of the annealing furnace. In addition, in skin pass rolling, surface roughness of steel sheets is adjusted, and oil is also coated thereon. Depending on the requests of customers, the surface roughness of the steel sheets may be controlled in the range of about 0.1 to 2.0 $\mu$m as an arithmetic mean roughness ($R_a$) The coating oils may be specified by the customers. In addition, when necessary, coating is performed. In this case, coating must be performed at about 300° C. or less. The reason for this is that hardening effects at the surface portions of steel sheets should not be lost.

The following Examples are illustrative of the invention. They are not intended to define or to limit the scope of the invention, which is defined in the appended claims.

EXAMPLE 1

A steel slab which was composed of 0.012 wt % C, 0.25 wt % Si, 0.25 wt % Mn, 0.08 wt % P, 0.004 wt % S, 0.35 wt % Al, 0.003 wt % N, 0.003 wt % O, and iron (Fe) and incidental impurities as the balance was formed by continuous casting. The steel slab was hot rolled to 2.6 mm thick at a reheating temperature of 1,120° C., at a finishing temperature of 820° C., and at a coiling temperature of 550° C. The hot-rolled sheet was pickled and then cold rolled to 0.51 mm thick. The cold-rolled sheet was degreased, then annealed at 730° C. for 40 seconds and subsequently cooled at a rate of 20° C./second. Next, the annealed sheet was divided into four segments, and the segments were skin pass rolled to 0.50 mm thick at a reduction rate of 2.5% after 10, 20, 30, and 50 hours passed, respectively.

For evaluation of workability, a test sample of 15 mm by 15 mm square was die-cut from the skin pass rolled steel sheet, and the die-cut face was observed. From the observation of the die-cut face, the flash height and the areal ratio of a shear portion in the thickness direction were measured. In this step, a clearance in die cutting was set to be 25 $\mu$m.

In addition, stress relief annealing of 750° C. for 2 hours was performed to the skin pass rolled steel sheets, and subsequently, the magnetic properties thereof were evaluated. Four Epstein test specimens were cut away in the L direction and the C direction, respectively, and eight-specimen Epstein test was performed. The magnetic flux density $B_{50}$ (T) and the iron loss $W_{15/50}$ (W/kg) were respectively measured, and the results are shown in Table 3. When skin pass rolling was performed within 20 hours after rapid cooling, it was found that superior workability and superior magnetic properties were obtained.

EXAMPLE 2

A steel slab which was composed of 0.003 wt % C, 0.35 wt % Si, 0.25 wt % Mn, 0.05 wt % P, 0.004 wt % S, 0.40 wt % Al, 0.002 wt % N, 0.002 wt % 0, and Fe and incidental impurities as the balance was formed by continuous casting. The steel slab was hot rolled to 2.6 mm thick at a reheating temperature of 1, 120° C., at a finish temperature of 820° C., and at a coiling temperature of 550° C. The hot-rolled sheets were pickled and then cold rolled to 0.51 mm thick. The cold-rolled sheets were degreased, and then annealed at 750° C. for 40 seconds. In the following cooling step after annealing, the cold-rolled coils were slowly cooled at a rate of 5° C./second to 700, 650, 600, 550, and 500° C., respectively, and they were subsequently rapid cooled to 300° C. at a rate of 20° C./second. In addition, by using a skin pass rolling mill provided at the side where steel sheets are discharged, annealed sheets were skin pass rolled to 0.50 mm thick at a reduction rate of 2.5%. Workability and magnetic properties were evaluated in a manner equivalent to those performed in Example 1. The results are shown in Table 4. When rapid cooling was started at 600° C. or more, it was found that superior workability and superior magnetic properties could be obtained, although lower temperatures such as those in conditions 4 and 5 are satisfactory.

EXAMPLE 3

Steel slabs having compositions shown in Table 5 were formed by continuous casting. The steel slabs were hot-rolled to 2.6 mm thick at a reheating temperature of 1,150° C., and at a coiling temperature of 550° C. The hot-rolled sheets were pickled and were cold rolled to 0.51 mm thick. The cold-rolled coils were degreased, then annealed at 700° C. for 60 seconds, and were subsequently cooled from 650 to 300° C. at a rate of 20° C./second. The annealed coils were skin pass rolled to 0.50 mm thick at a reduction rate of 2.5% by a skin pass rolling mill provided at a discharge side of the annealing furnace. Workability and magnetic properties were evaluated in a manner equivalent to those performed in Example 1. The results are shown in Table 6. By using steels having compositions according to the present invention, it was found that superior workability and superior magnetic properties could be obtained.

TABLE 1

| | | Magnetic properties | | Evaluation of Workability | |
|---|---|---|---|---|---|
| Condition | Skin pass rolling reduction rate (%) | Magnetic flux density $B_{50}$ (T) | Iron loss $W_{15/50}$ (W/kg) | Areal ratio of shear portion (%) | Flash height (μm) |
| 1 | 0 | 1.68 | 7.3 | 60 | 14 |
| 2 | 0.5 | 1.74 | 5.2 | 60 | 7 |
| 3 | 1.0 | 1.75 | 5.0 | 70 | 5 |
| 4 | 2.0 | 1.76 | 4.8 | 70 | 5 |

TABLE 1-continued

| | | Magnetic properties | | Evaluation of Workability | |
|---|---|---|---|---|---|
| Condition | Skin pass rolling reduction rate (%) | Magnetic flux density $B_{50}$ (T) | Iron loss $W_{15/50}$ (W/kg) | Areal ratio of shear portion (%) | Flash height (μm) |
| 5 | 5.0 | 1.76 | 4.8 | 70 | 5 |
| 6 | 10.0 | 1.76 | 4.8 | 40 | 16 |

TABLE 2

| Steel | Average cooling rate (° C./s) | Magnetic flux density $B_{50}$ (T) | Iron loss $W_{15/50}$ (W/kg) | Areal ratio of shear portion (%) | Flash height (μm) |
|---|---|---|---|---|---|
| A | 5 | 1.78 | 4.0 | 40 | 16 |
| | 10 | 1.78 | 4.0 | 40 | 15 |
| | 50 | 1.78 | 4.0 | 45 | 16 |
| B | 5 | 1.78 | 4.0 | 40 | 14 |
| | 10 | 1.78 | 4.0 | 70 | 5 |
| | 50 | 1.78 | 4.0 | 75 | 7 |
| C | 5 | 1.78 | 4.0 | 40 | 14 |
| | 10 | 1.78 | 4.0 | 70 | 5 |
| | 50 | 1.78 | 4.0 | 75 | 7 |
| D | 5 | 1.76 | 4.4 | 40 | 14 |
| | 10 | 1.76 | 4.4 | 70 | 5 |
| | 50 | 1.76 | 4.4 | 75 | 7 |
| E | 5 | 1.74 | 4.8 | 40 | 14 |
| | 10 | 1.74 | 4.8 | 70 | 5 |
| | 50 | 1.74 | 4.8 | 75 | 7 |
| F | 5 | 1.66 | 7.5 | 40 | 14 |
| | 10 | 1.66 | 7.5 | 60 | 8 |
| | 50 | 1.66 | 7.5 | 70 | 5 |

TABLE 3

| | | Magnetic properties | | Evaluation of Workability | | |
|---|---|---|---|---|---|---|
| Condition | Time after rapid cooling (Hr) | Magnetic flux density $B_{50}$ (T) | Iron loss $W_{15/50}$ (W/kg) | Areal ratio of shear portion (%) | Flash height (μm) | Remarks |
| 1 | 10 | 1.78 | 4.2 | 70 | 5 | Inventive |
| 2 | 20 | 1.78 | 4.2 | 70 | 5 | Inventive |
| 3 | 30 | 1.78 | 4.2 | 55 | 12 | Comparative |
| 4 | 50 | 1.78 | 4.2 | 45 | 16 | Comparative |

TABLE 4

| | | Magnetic properties | | Evaluation of Workability | | |
|---|---|---|---|---|---|---|
| Condition | Temperature of starting rapid cooling (° C.) | Magnetic flux density $B_{50}$ (T) | Iron Loss $W_{15/50}$ (W/kg) | Areal ratio of shear portion (%) | Flash height (μm) | Remarks |
| 1 | 700 | 1.78 | 3.8 | 70 | 5 | Inventive |
| 2 | 650 | 1.78 | 3.8 | 70 | 5 | |
| 3 | 600 | 1.78 | 3.8 | 70 | 5 | |
| 4 | 550 | 1.78 | 3.8 | 45 | 14 | Inventive |
| 5 | 500 | 1.78 | 3.8 | 40 | 18 | |

TABLE 5

| | C (wt %) | Si (wt %) | Mn (wt %) | P (wt %) | S (wt %) | Al (wt %) | N (wt ppm) | O (wt ppm) | Sb (wt %) | Sn (wt %) | B (wt ppm) | Others (wt %) | Others (wt %) | $C_{eq.}$ (wt %) |
|---|---|---|---|---|---|---|---|---|---|---|---|---|---|---|
| A | 0.002 | 0.30 | 0.25 | 0.02 | 0.002 | 0.25 | 0.002 | 0.003 | 0.05 | — | — | Cu; 0.1 | Nb; 0.003 | 0.0004 |
| B | 0.004 | 0.20 | 0.25 | 0.02 | 0.002 | 0.35 | 0.004 | 0.002 | — | 0.05 | — | Ni; 0.1 | Ti; 0.004 | 0.0010 |
| C | 0.006 | 0.30 | 0.25 | 0.05 | 0.003 | 0.30 | 0.003 | 0.002 | — | — | 20 | — | — | — |
| D | 0.006 | 0.50 | 0.25 | 0.05 | 0.002 | 0.10 | 0.003 | 0.003 | | | — | Cu; 0.1 | — | — |
| E | 0.008 | 0.25 | 0.25 | 0.08 | 0.004 | 0.25 | 0.002 | 0.002 | 0.05 | — | 15 | — | — | — |
| F | 0.012 | 0.15 | 0.25 | 0.08 | 0.005 | 0.75 | 0.004 | 0.001 | — | — | — | Ni; 0.1 | — | — |
| G | 0.023 | 0.15 | 0.25 | 0.12 | 0.003 | 0.50 | 0.003 | 0.003 | — | 0.05 | — | — | — | — |
| X | 0.001 | 0.20 | 0.25 | 0.05 | 0.004 | 0.50 | 0.003 | 0.002 | 0.05 | — | — | Cu; 0.1 | Ti; 0.004<br>Zr; 0.003 | 0.0014 |
| Y | 0.001 | 0.30 | 0.25 | 0.05 | 0.002 | 0.25 | 0.003 | 0.003 | — | — | 20 | — | Nb; 0.006<br>V; 0.004 | 0.0017 |

TABLE 6

| | Magnetic flux density $B_{50}$ (T) | Iron loss $W_{15/50}$ (W/kg) | Areal ratio of shear portion (%) | Flash height ($\mu$m) | Remarks |
|---|---|---|---|---|---|
| A | 1.77 | 4.0 | 70 | 5 | Inventive |
| B | 1.77 | 3.9 | 70 | 5 | |
| C | 1.78 | 3.8 | 70 | 5 | |
| D | 1.78 | 3.8 | 70 | 5 | |
| E | 1.78 | 3.8 | 70 | 5 | |
| F | 1.76 | 4.2 | 70 | 5 | |
| G | 1.75 | 4.8 | 70 | 5 | |
| X | 1.76 | 5.2 | 40 | 15 | Inventive |
| Y | 1.75 | 6.1 | 40 | 15 | |

As has thus been described, by a method for manufacturing semiprocessed non-oriented magnetic steel sheets according to the present invention, semiprocessed non-oriented magnetic steel sheets can be manufactured which have superior workability together with superior magnetic properties after stress relief annealing.

What is claimed is:

1. A method for manufacturing a non-oriented magnetic steel sheet having superior workability and superior magnetic properties after stress relief annealing, comprising the steps of:

hot rolling a steel slab containing about 0.001 to 0.03 wt % carbon, about 0.1 to 1.0 wt % silicon, about 0.01 to 1.0 wt % aluminum, about 0.05 to 1.0 wt % manganese, and about 0.001 to 0.15 wt % phosphorus;

cold rolling the hot rolled sheet;

continuous annealing the cold rolled sheet; and skin pass rolling the annealed sheet;

wherein the average cooling rate in the continuous annealing process is about 10° C./second or more; and wherein said skin pass rolling of said sheet is conducted at a reduction rate of about 0.5 to 5% within about 20 hours after continuous annealing.

2. The method for manufacturing a non-oriented magnetic steel sheet, according to claim 1, wherein said cooling in said continuous annealing step is performed at a rate of about 10° C./second or more between about 600 to 400° C.

3. The method for manufacturing a non-oriented magnetic steel sheet, according to one of claims 1 or 2, herein said steel slab further comprises at least one of about 0.001 to 0.20 wt % tin, about 0.001 to 0.10 wt % antimony, and about 0.001 to 0.010 wt % boron.

4. The method according to either of claims 1 and 2, wherein the difference between the amount of carbon contained in said steel slab and a $C_{eq}$ value obtained by the equation below is 0.001 wt % or more, in which the $C_{eq}$ value is calculated from wt % amounts of impurities titanium, niobium, vanadium, and zirconium mixed in the steel slab, using the following formula:

$$C_{eq}(\text{wt }\%)=12\times\{[\text{Ti}(\text{wt }\%)]/48+[\text{Nb}(\text{wt }\%)]/93+[\text{V}(\text{wt }\%)]/51+[\text{Zr}(\text{wt }\%)]/92\}.$$

* * * * *